US006572037B1

(12) United States Patent
Bendzick

(10) Patent No.: US 6,572,037 B1
(45) Date of Patent: Jun. 3, 2003

(54) SHREDDER WITH PARTS EJECTOR

(75) Inventor: Ervin J. Bendzick, New Prague, MN (US)

(73) Assignee: MCT Holdings, LLC, Minnetonka, MN (US)

( * ) Notice: Subject to any disclaimer, the term of this patent is extended or adjusted under 35 U.S.C. 154(b) by 0 days.

(21) Appl. No.: 09/889,431

(22) PCT Filed: Jan. 26, 2000

(86) PCT No.: PCT/US00/02090

§ 371 (c)(1),
(2), (4) Date: Jul. 11, 2001

(87) PCT Pub. No.: WO00/45958

PCT Pub. Date: Aug. 10, 2000

Related U.S. Application Data

(60) Provisional application No. 60/118,595, filed on Feb. 4, 1999.

(51) Int. Cl.[7] ..... B02C 25/00

(52) U.S. Cl. ..... 241/36; 241/166; 241/236; 241/285.2

(58) Field of Search ..... 241/33, 36, 37.5, 241/166, 167, 236, 285.2, 285.3

(56) References Cited

U.S. PATENT DOCUMENTS

| | | | | |
|---|---|---|---|---|
| 4,018,392 A | | 4/1977 | Wagner | 241/167 |
| 4,489,897 A | | 12/1984 | Turner et al. | 241/167 |
| 4,495,456 A | | 1/1985 | Vercillo et al. | 318/755 |
| 4,529,137 A | | 7/1985 | Williams | 241/30 |
| 4,721,257 A | | 1/1988 | Williams et al. | 241/36 |
| 4,944,462 A | | 7/1990 | Raterman et al. | 241/100 |
| 5,603,459 A | | 2/1997 | Gearing et al. | 241/56 |
| 5,722,604 A | | 3/1998 | Dudley | 241/24.11 |
| 5,829,690 A | | 11/1998 | Deschamps | 241/36 |
| 6,357,680 B1 | * | 3/2002 | Irwin | 241/167 |

* cited by examiner

*Primary Examiner*—John M. Husar
(74) *Attorney, Agent, or Firm*—Westman, Champlin & Kelly, P.A.

(57) ABSTRACT

A shredder for shredding metal shavings, chips and the like includes a housing (10) containing a shredder assembly having first and second roller motor-operated shafts (40,42) carrying spaced knives (50) for shredding metal. A sensor (66,68) on at least one shaft (40,42) senses a change in rotation of the shaft, indicative of a jammed condition. A microprocessor (70) responds to the sensor to open an ejection door (20) normally closing an ejection outlet (16) and to reverse rotation of the shaft (42) to dislodge the jamming object. When the jamming object is dislodged, the microprocessor halts rotation of one shaft (40) to permit the knives on the reverse rotating shaft (42) to carry the jamming object toward the open ejection outlet (16). After the object has been ejected, the microprocessor (70) returns the shafts (40,42) to their normal operation to continue shredding metal. A cleaning assembly (54,56) is provided with cleaning fingers (58) to clean debris from the space between the knives and is provided with guide fingers (72,73) to guide metal to be shredded to the shredder assembly and to guide jamming objects from the shredder assembly to the ejection outlet (16).

18 Claims, 6 Drawing Sheets

SHREDDER WITH PARTS EJECTOR

CROSS REFERENCE TO RELATED APPLICATION

This application is a Section 371 Application of International Application No. PCT/US00/02090 filed Jan. 26, 2000, which in turn claims benefit of U.S Provisional Application No. 60/118,595, filed Feb. 4, 1999.

BACKGROUND OF THE INVENTION

The invention relates to metal shredders, and particularly to metal shredders that sense and eject larger objects that jam the shredder.

Machine shops fabricate metal objects by cutting, grinding, bending and welding metal into parts and fastening the parts together with bolts or other fasteners to complete the metal object. During these fabrication processes, metal shavings, chips and the like result from the processing of the metal. It is the practice of most machine shops to collect the shavings, chips and the like for recycling.

There have been several difficulties with recycling the metal shavings, chips and the like. Handling and transporting the shavings, chips and the like from the machine shop to the foundry is inefficient and costly; the shavings, chips and the like are usually laden with cutting oil, requiring costly recycling processes to remove the oil. One solution to these problems is to compact the metal shavings, chips and the like at the machine shop into a form that is easily handled and transported. One such machine for compacting metal shavings, chips and the like is the Puckmaster™ metal compactor available from MCT Manufacturing of Montgomery, Minn. This compactor, which is described in my U.S. Pat. Nos. 5,391,069, 5,542,348 and 5,542,348, compacts metal shavings, chips and the like at high pressures (25,000 to 42,000 psi) to form metal pellets. The pellets have a diameter of about 3½ inches and a thickness between about 1 and 2 inches and, because they resemble hockey pucks, they are known in the trade as "pucks". With the Puckmaster compactor, machine shops can compact scrap shavings, chips and the like, retrieved from sweeping from the machine shop floor. The compacting process extrudes cutting oil from the shavings, chips and the like which is recovered for reuse by the machine shop.

The pellets or "pucks" formed from scrap metal shavings, chips and the like by metal compactors like the Puckmaster machine are easily handled and transported to a recycling foundry where the metal is reclaimed from the pellets. Moreover, because the pucks are substantially free of cutting oil, they can be more economically recycled, resulting in higher prices received from recycling foundries for the pucks. These factors result in considerable cost savings to the machine shop, as well as more efficient recycling by the foundry.

The compactor compacts the scrap metal chips and shavings retrieved from the shop floor. In many cases the chips and shavings need to be shredded into a smaller size for compacting. Additionally, small sheet metal scraps discarded by the shop operators are collected with the shavings and chips on the floor to be compacted by the compactor. These sheet metal scraps and the like also need to be shredded before compacting. Accordingly, there is a need for a metal shredder to shred metal scraps into chips and shavings suitable for compacting into pucks by a compactor, such as the Puckmaster compactor. However, larger parts and spare items, such as bolts and brackets, occasionally fall onto the shop floor and are mixed into, and collected with, the metal chips and shavings for shredding and compacting. These larger parts and objects present a problem because they will jam the shredder. Therefore, there is a need for a shredder that automatically ejects the larger objects from the metal chips and shavings before shredding is attempted.

BRIEF SUMMARY OF THE INVENTION

Apparatus is provided for shredding metal shavings, chips and the like and for ejecting larger objects. In one form of the invention, the apparatus includes a housing having first and second opposing walls forming a shredder chamber, an inlet for admitting metal chips and shavings to be shredded into the shredder chamber, an ejection outlet for discharging jamming objects from the shredder chamber, and a shredder outlet for discharging the shredded shavings, chips and the like from the housing. A shredder assembly is mounted in the housing between the shredder chamber and the shredder outlet. The shredder assembly includes a plurality of first knives mounted to a first roller shaft mounted between the first and second walls. A plurality of second knives are mounted to a second roller shaft mounted between the first and second walls, the first and second roller shafts being positioned within the housing so that the first and second knives mesh to shred metal shavings, chips and the like upon rotation of the first and second roller shafts. A motor assembly rotates the first and second roller shafts, and a sensor is operatively associated with at least one of the roller shafts to sense rotation of the one roller shaft. A microprocessor is coupled to the motor assembly to control rotation of the roller shafts. The microprocessor is programmed to, operate the motor assembly to rotate the first and second roller shafts in a shredding direction to draw metal shavings, chips and the like to be shredded into the first and second knives. The microprocessor is further programmed to be responsive to the sensor sensing a change in motion of the one roller shaft due to a jamming object in the first and second knives to first operate the motor assembly to rotate the first and second roller shafts in a reverse direction to dislodge the jamming object from the first and second knives and then to operated the motor assembly to halt rotation of the second roller shaft while continuing rotation of the first roller shaft in the reverse direction to discharge the jamming object to the ejection outlet.

The housing may include an ejection door having a closed position closing the ejection outlet and an open position permitting discharged jamming objects to be ejected through the ejection outlet. A motor control operates the ejection door between its closed and open positions. The microprocessor is further programmed to operate the control to move the ejection door from its closed to its open position when the sensor senses a change in motion of at least one roller shaft due to a jamming object. Preferably, the microprocessor is further programmed to operate the control to move the ejection door from its open to its closed position after the jamming object has been ejected through the ejection outlet.

In one form of the invention, the control includes a door motor for operating the ejection door between its closed and its open position. The door includes a plurality of first and second followers on the ejection door and corresponding first and second guides on each of the first and second walls. The first followers track the first guides and the second followers track the second guides, with the first and second guides being arranged as to guide the followers to pivotly move the ejection door so that as the ejection door pivots from its closed to its open positions, it sweeps shavings, chips and the like from the shredder assembly.

In another form of the invention, the shredder assembly includes spacers on at least one of the roller shafts and between each adjacent knife on the roller shaft to space the knives along the roller shaft. A cleaning assembly is mounted to the housing adjacent at least the first roller shaft. The cleaning assembly has a plurality of cleaning fingers extending into the space between the knives to clean the space of material, In this form of the invention, the cleaning assembly may optionally include a plurality of guide fingers extending into the space between the first knives to transport dislodged jamming objects to the ejection outlet.

Preferably, the apparatus includes a second cleaning assembly adjacent the second rotation shaft with cleaning fingers arranged to clean material from the space between the second knives. A plurality of second guide fingers extend into the space between the second knives for transporting shavings, chips and the like admitted through the inlet to the first and second knives.

DETAILED DESCRIPTION

Figure 1:
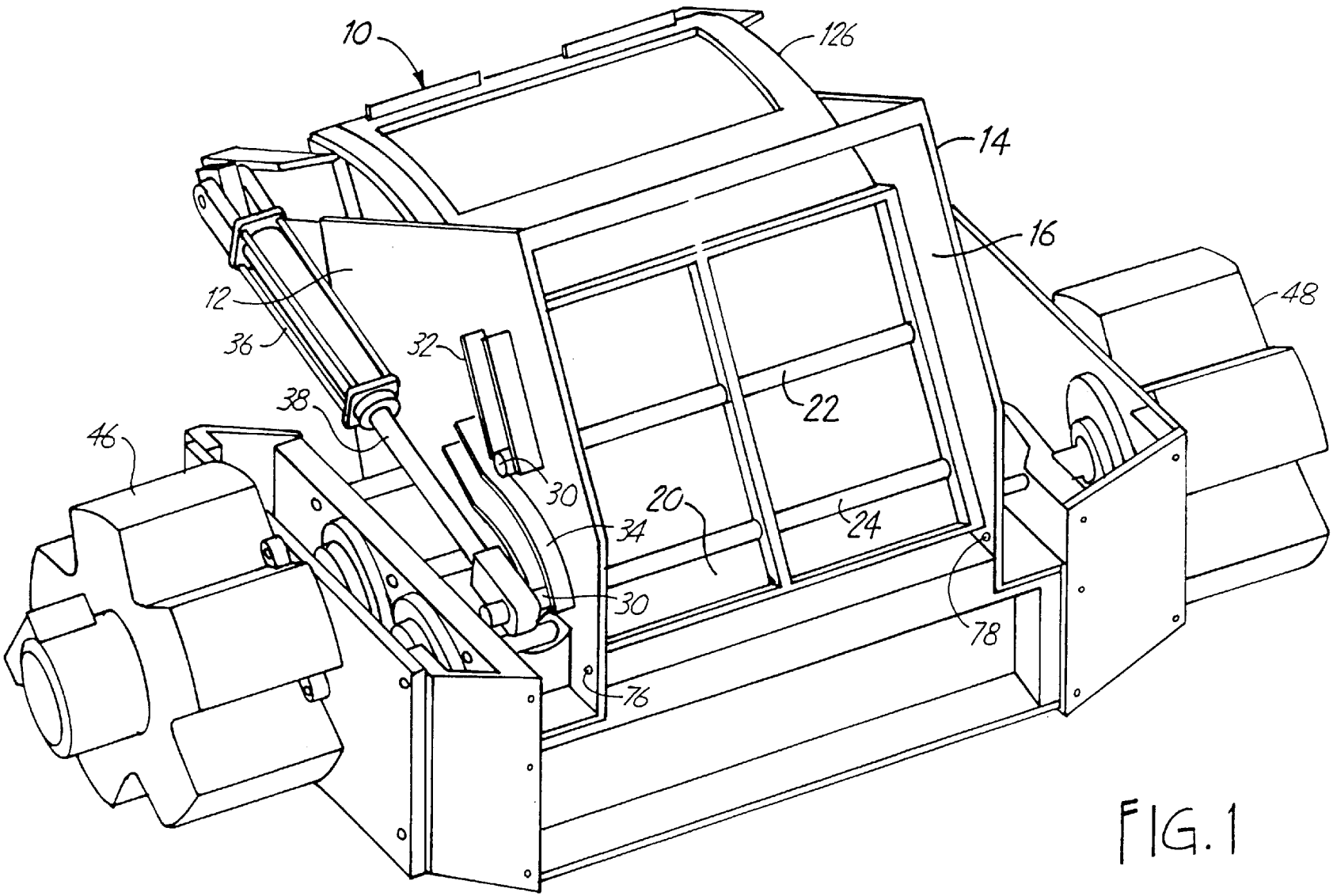
FIG. 1 is a perspective view of a metal shredder according to the presently preferred embodiment of the present invention, the shredder being shown with an ejector door in a closed position.
Figure 2:
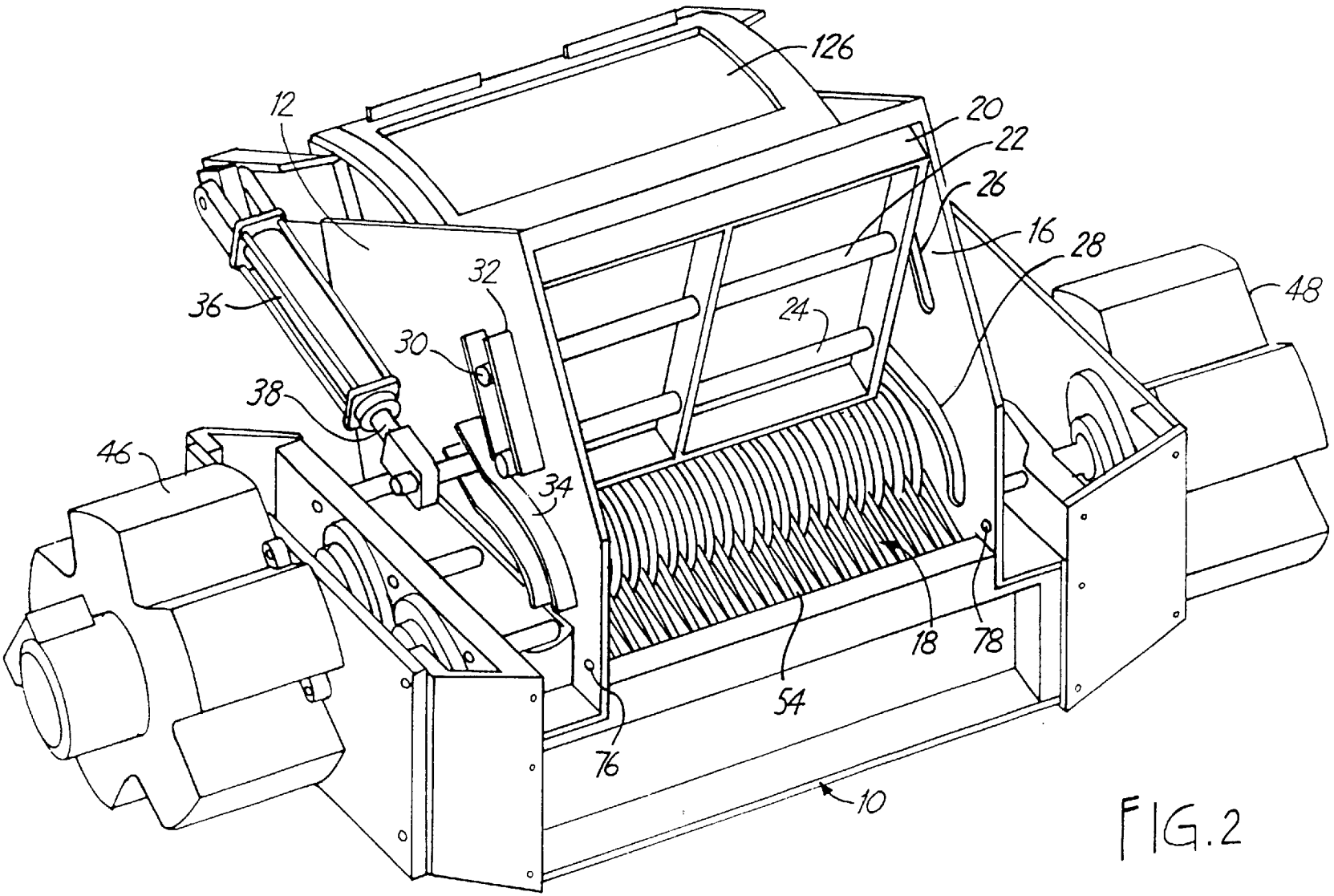
FIG. 2 is a perspective view, as in FIG. 1, of the metal shredder with the ejector door in an open position.
Figure 3:
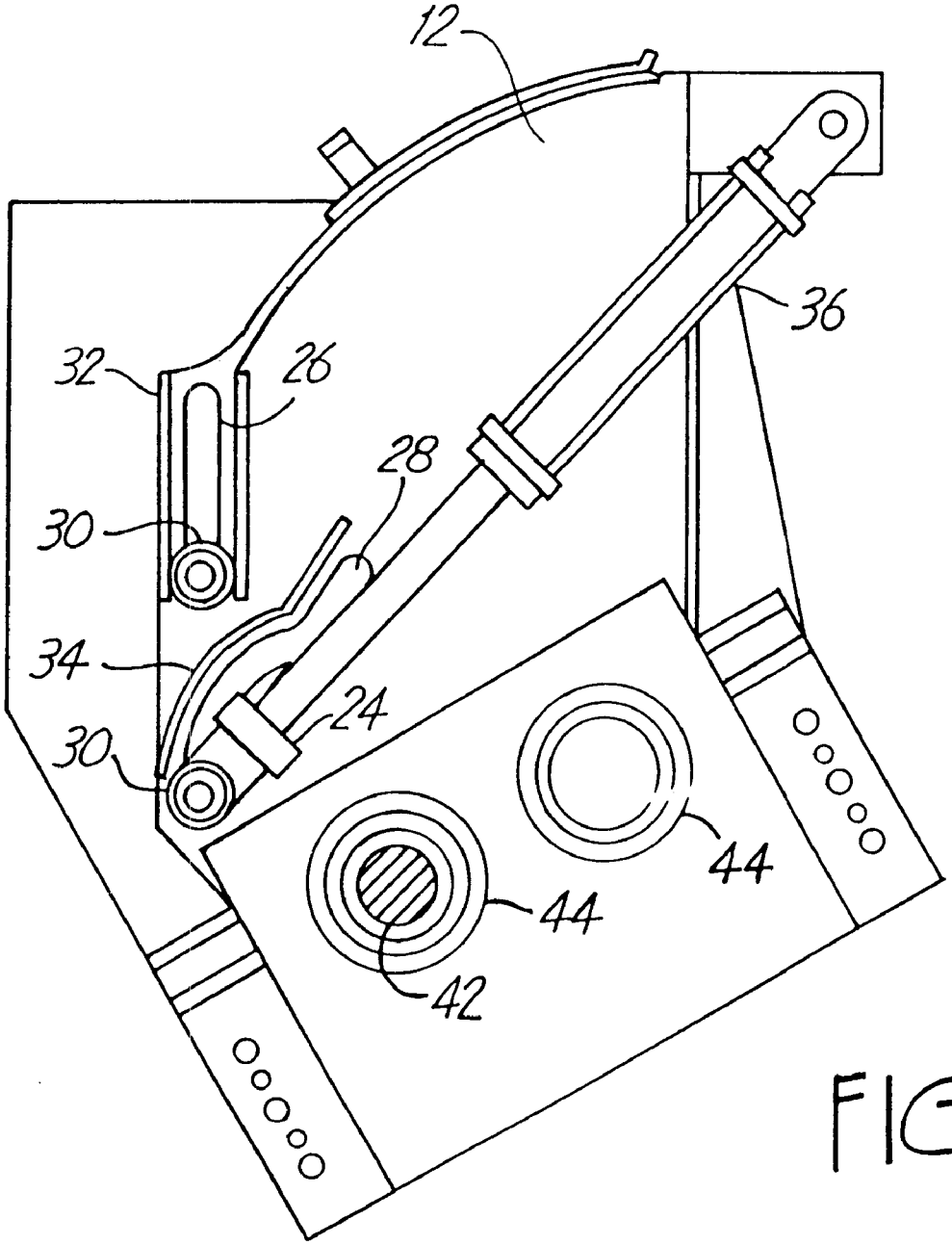
FIG. 3 is a side view, with motors and cover removed, taken along plane 3—3 in FIG. 4, of the metal shredder.
Figure 4:
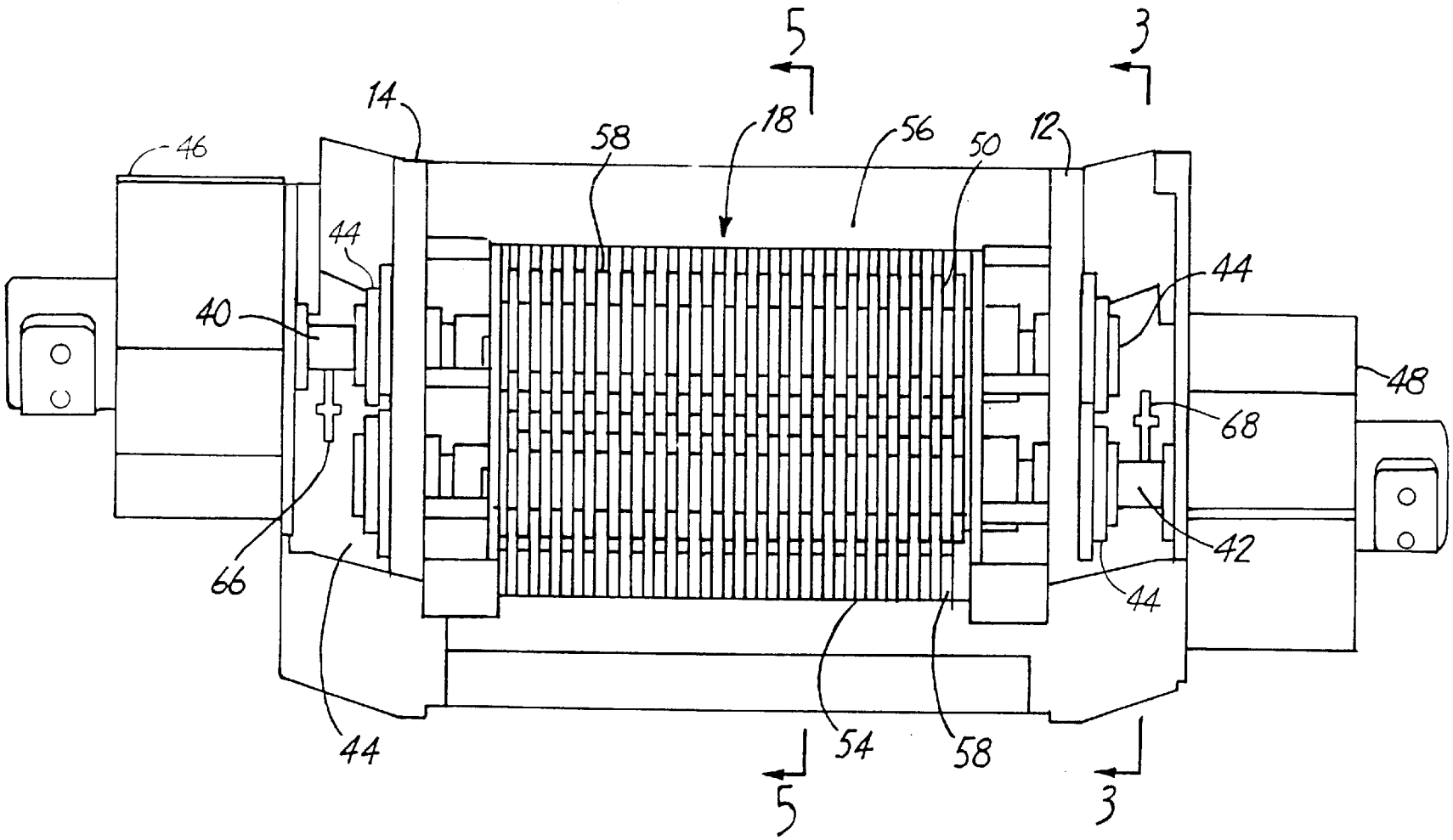
FIG. 4 is a top view of a portion of the shredder with the housing removed.
Figure 5:
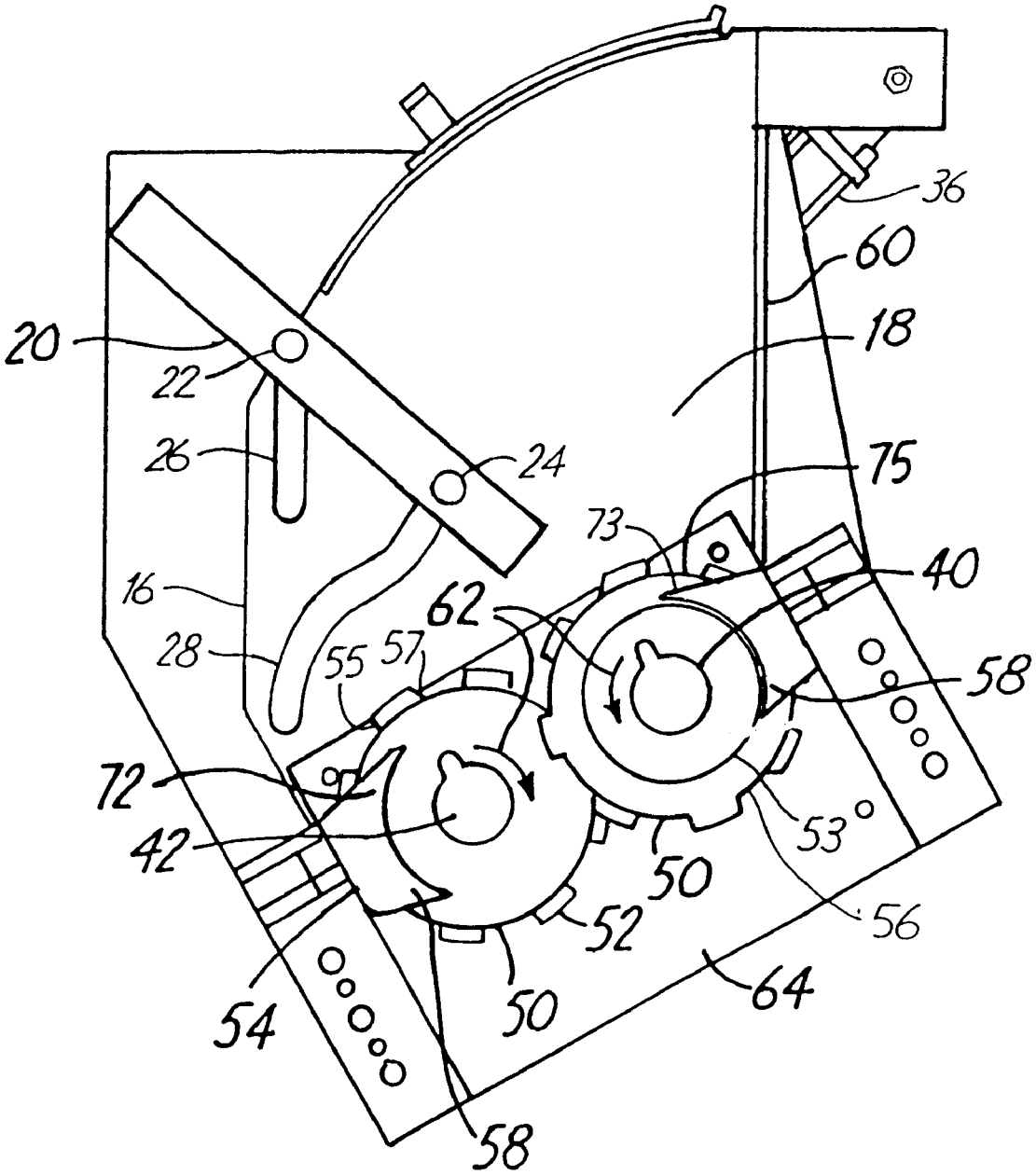
FIG. 5 is a section view, taken along plane 5—5 in FIG. 4, of the shredder illustrating details of the shredder assembly.
Figure 6:
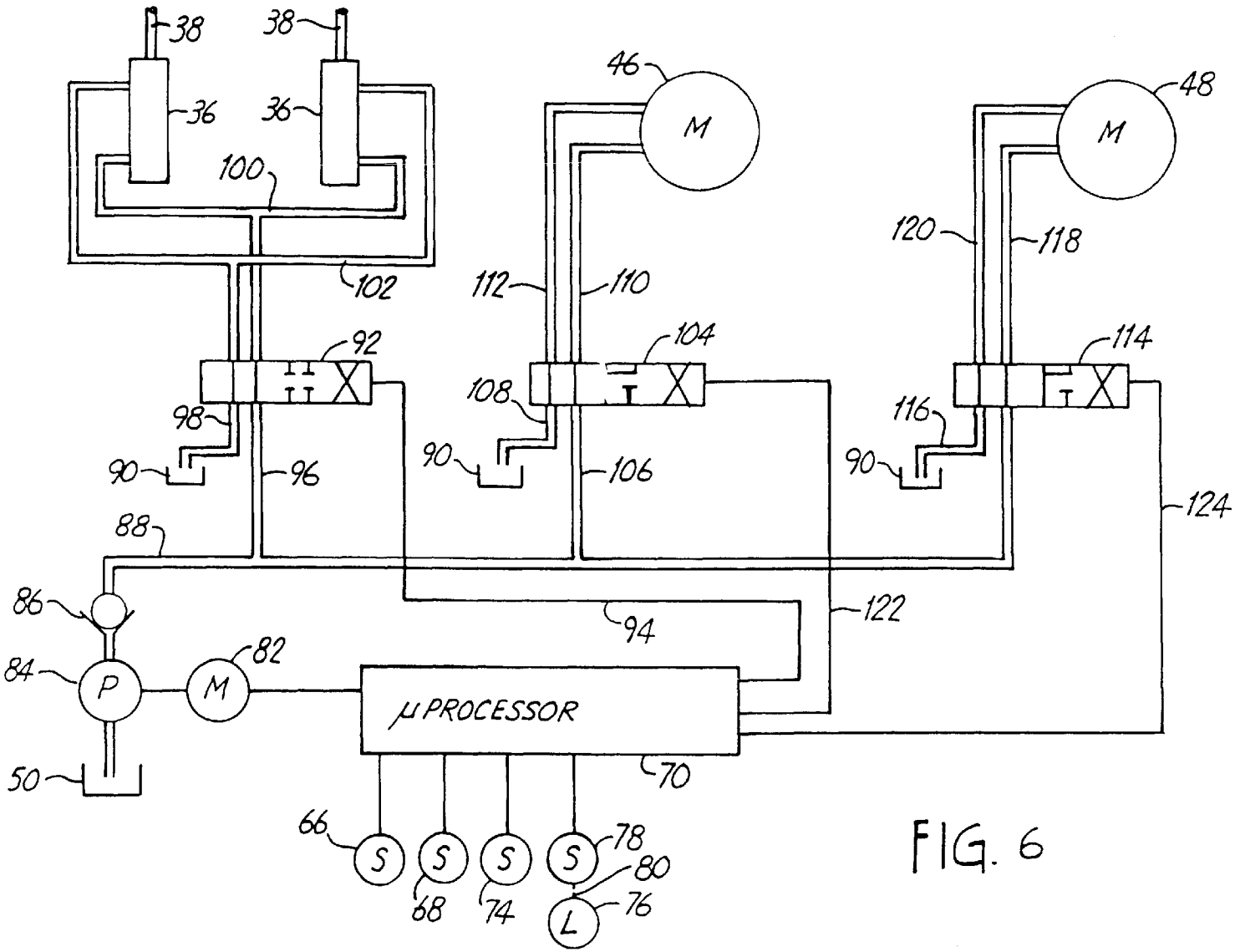
FIG. 6 is a diagram of the hydraulic circuit for operating the shredder.

FIGS. 1–5 illustrate the apparatus forming the metal shredder according to the present preferred embodiment of the present invention, and FIG. 6 is a diagram of the hydraulic circuit for the apparatus of FIGS. 1–5. The apparatus includes a housing 10 having opposite side walls 12 and 14 forming an ejection outlet 16 for an internal chamber 18. Door 20 includes a pair of shafts 22 and 24 that are journaled to the door and extend through respective slots 26 and 28 in side walls 12 and 14. The ends of shafts 22 and 24 include followers 30 arranged to follow tracks 32 and 34 on the outside of each side wall 12 and 14. A hydraulic cylinder 36 is mounted on each side wall of the housing and includes an operable shaft 38 coupled to a respective end of shaft 24 of door 20. Each hydraulic cylinder 36 includes a piston (not shown) connected to shaft 38 in a well-known manner so that application of hydraulic pressure to cylinder 36 moves the piston within the cylinder to axially move shaft 38. As the shaft 38 is withdrawn into the cylinder, follower 30 on shaft 24 travels rearwardly along track 34 to pull the lower portion of door 20 rearwardly. As the lower portion of door 20 moves rearwardly, follower 30 on shaft 22 rises upwardly within track 32, thereby pivotly moving the door to the open position illustrated in FIG. 2. Extending shaft 38 outwardly from cylinder 36 causes an opposite motion of the followers within the tracks, thereby moving door 20 to its closed position illustrated in FIG. 1.

As shown particularly in FIGS. 4 and 5, the shredder assembly comprises roller shafts 40 and 42 each journaled by bearings 44 to a respective side wall 12 and 14, with shaft 40 extending through side wall 14 to be driven by hydraulic motor 46, and shaft 42 extending through side wall 12 to be driven by hydraulic motor 48. A plurality of circular steel knives 50 are mounted to each of shafts 40 and 42. Each circular knife 50 has a plurality of radially extending steel teeth or knife blades or hooks 52 spaced about the periphery of the circular knife. Spacers 53 are sandwiched between the circular knives 50 on each shaft, the spacers having a limited radial extent to thereby form a space between adjacent knives on the same shaft.

Cleaning assemblies 54 and 56 include a bracket mounted to respective front and back walls of housing 10 with a plurality of steel fingers 58 extending into the space defined by spacers 53 between respective knives 50 on each shaft 40 and 42, the fingers extending toward the respective axes of shafts 40 and 42 by an amount that clears spacers 53 As shown particularly in FIGS. 4 and 5 the circular knives on each shaft 40 and 42 are interleaved so that teeth or blades or hooks 52 mesh when shafts 40 and 42 are rotated in opposite directions. As will be more fully understood hereinafter, motor 46 normally operates to drive shaft 40 in the counterclockwise direction (as viewed in FIG. 5) while motor 48 drives shaft 42 in the clockwise direction.

In operation of the apparatus thus far described, with door 20 in the closed position to close ejector opening 16, metal shavings, chips and the like to be shredded are fed into inlet opening 60 (FIG. 5) while motors 46 and 48 operate to drive shafts 40 and 42 in the direction of arrows 62. Guide fingers 73 on cleaning assembly 56 guide metal shavings, chips and the like to be shredded from inlet 60 over the knives on shaft 40 to the central portion of the shredder for shredding. The metal shavings, chips and the like are "captured" by blades 52 on knives 50 mounted to shafts 40 and 42 to "draw" shavings, chips and the like into the region between the knives to shred the shavings, chips and the like for discharge through outlet 64. As the knives rotate, fingers 58 on cleaning assemblies 54 and 56 engage any scrap or debris that might cling to the knives to assure their continued discharge through the outlet. Outlet 64 may be mounted to the inlet hopper of the Puckmaster metal compactor. Conveniently, metal shavings, chips and the like may be input through inlet 60 through a side hopper and auger (not shown), such as described in my aforementioned patents.

Sensors 66 and 68 are mounted to respective shafts 40 and 42 to detect rotational motion of the shafts. If either shaft ceases to rotate, such as due to a jam caused by a large object between the cutting teeth or knife blades 52 on opposing circular knives 50 on shafts 40 and 42, one or both sensors 66 and 68 sense the change in rotation, or halt, of the respective shaft and supplies a signal to microprocessor 70 to operate hydraulic cylinders 36 to open door 20. At the same time microprocessor operates motors 46 and 48 to stop rotation of shafts 40 and 42. The pivotal movement of door 20 to its open position pushes most of the scrap shavings, chips and the like that may be in chamber 18 toward inlet 60 and away from the region of circular knives 50. When door 20 reaches its open position, microprocessor 70 operates motors 46 and 48 in a reverse direction, so that shaft 40 rotates clockwise and shaft 42 rotates counterclockwise (as viewed in FIG. 5) to dislodge the jamming object or part from the knives. Motor 46 is then halted, and motor 48 continues to drive shaft 42 in the counterclockwise direction so that the knife blades 52 on the knives en shaft 42 carry the part or object toward outlet 16.

Outlet 16 is arranged somewhat lower than the top of knives 50 on shaft 42, which in turn are lower than knives 50 on shaft 40. Inlet 60 is arranged above and upstream from the normal rotational movement of knives 50 on shaft 40. This arrangement allows the metal to be shredded to flow smoothly by gravity from inlet 60 to the region between knives 50 on shafts 40 and 42 to shred the metal.

The arrangement also allows objects dislodged from the knives to be carried by aid of gravity and the reversed motion of shaft 42 out of chamber 18 through ejector outlet 16. Thus, knife blades 52 include a blunt surface 55, opposite the shearing surface 57 of the blade, to engaging and dislodge jamming objects during reverse rotation of shaft 42 and to urge the objects away from the knives and toward outlet 16. Guide fingers 72 on cleaning assembly 54 serve to guide the dislodged jamming object or part being ejected past the knives on shaft 42 to and through outlet 16. After the part or object causing the jam has been ejected through outlet 16, motor 48 is again stopped and hydraulic cylinders 36 are operated to move door 20 to its closed position, whereupon motors 46 and 48 are again operated to drive shaft 40 in the counterclockwise direction and to drive shaft 42 in the clockwise direction (as viewed in FIG. 5).

Conveniently, the entire operation of part ejection is automatic under the control of microprocessor 70, so that upon sensing a jamming condition the microprocessor operates hydraulic cylinders 36 to open door 20 and operates motors 46 and 48 to a stopped condition. After door 20 moves to its open position, microprocessor 70 operates motors 46 and 48 in a reversed direction to dislodge the jamming part or object. When sensors 66 and 68 both sense that shafts 40 and 42 are rotating in the opposite direction indicating that the jamming object has dislodged from the knives, microprocessor 70 operates motor 48 to stop while continuing to operate motor 46 in the reversed direction to eject the jamming object through outlet 16 and past door 20. After the jamming object has been ejected through ejection outlet 16, microprocessor 70 operates motor 46 to a stopped condition and operates hydraulic cylinders 36 to move door 20 to its closed position. After door 20 closes, microprocessor 70 again operates motors 46 and 48 to their normal operation to drive shafts 40 and 42 to shred metal as described above.

Preferably, a position sensor 74 on one of hydraulic cylinders 36 senses the open and closed positions of door 20 and an object detector, such as a light beam source 76 and sensor 78 (FIG. 2), senses the ejection of the jamming object. If these optional sensors are employed, microprocessor 70 performs the following programmed sequence when a jamming object engages the knives of shafts 40 and 42:

1) sensor 66 and/or 68 senses the jammed condition by sensing a change in rotational movement of the respective shaft 40 and/or 42, causing microprocessor 70 to stop both motors 46 and 48 and operate cylinder 36 to open door 20;
2) sensor 74 senses that door 20 is open, causing microprocessor 70 to operate motors 46 and 48 in the reverse direction to dislodge the jamming object;
3) sensors 66 and 68 sense that shafts 40 and 42 are rotating in the reverse direction, causing microprocessor 70 to halt motor 46 (motor 48 continues to operate shaft 42 in the reverse direction); the jamming object is discharged from the shredder toward the ejection opening;
4) sensor 76/78 senses the presence, and then absence, of the jamming object through ejection opening 16, causing microprocessor 70 to operate hydraulic cylinders 36 to close door 20;
5) sensor 74 senses that door 20 is closed, causing microprocessor 70 operate motors 46 and 48 to the normal shredding mode.

As an alternative to sensor 74, microprocessor may operate with a time delay to presume the operation of opening and closing door 20. Thus, instead of operating microprocessor 70 in response to sensor 74 sensing the open or closed position of door 20, the microprocessor may simply operate motors 46 and 48 as described in steps 2 and 5 after a suitable time delay that permits the operations to be completed. Similarly, in place of sensor 76/78 sensing the presence and absence of the jamming object, microprocessor 70 may simply operate hydraulic cylinders 36 to close door 20 after a suitable time delay to permit ejection of the jamming object.

FIG. 6 is a diagram illustrating the controls, including the hydraulic circuit and the electric control circuit, for the present invention. Sensor 66, 68, 74 and 78 provide input to microprocessor 70 as previously described. Also, light source 76 provides a beam of light 80 across ejection opening 16 as previously described. Microprocessor 70 provides control signals to operate electric motor 82 which operates hydraulic pump 84 which supplies hydraulic fluid under pressure from sump 90 through check valve 86 to conduit 88. Three-way hydraulic valve 92 is operated by control line 94 from microprocessor 70. Valve 92 is connected on one side by conduit 96 to conduit 88 and by conduit 98 to sump 90. Hydraulic cylinders 36 are connected by conduits 100 and 102 to the opposite side of valve 92. When valve 92 is in the position illustrated in FIG. 6, pressure conduit 96 is in fluid communication with conduit 100 and drain conduit 98 is in fluid communication with conduit 102 to extend shafts 38 of cylinders 36 to thereby close door 20. When in the position opposite that illustrated in FIG. 6, valve 92 supplies hydraulic pressure via conduit 102 to operate cylinders 36 to axially withdraw shafts 38 to open door 20. In the middle position, valve 92 closes all conduits so pressure within conduits 100 and 102 remains as it was prior to moving to the middle position, thereby maintaining door 20 in the closed or open position, as the case may be. Microprocessor is programmed to operate valve 92 via control line 94 between the three positions to thereby operate door 20 between its closed and open position.

Three-way valve 104 has one side connected by conduit 106 to pressure conduit 88 and by conduit 108 to sump 90. The opposite side of valve 104 is connected by conduits 110 and 112 to opposite sides of motor 46. Similarly, three-way valve 114 has one side connected directly to pressure conduit 88 and through conduit 116 to sump 90, and the opposite side connected through conduits 118 and 120 to opposite sides of motor 48. When in the positions illustrated in FIG. 6, valves 104 and 114 serve to operate motors 46 and 48 in the shredding mode previously described. In a central position of valves 104 and 114, high pressure hydraulic fluid is blocked from motors 46 and 48 and fluid is drained from those motors through both supply conduits to sump 90, thereby halting rotation of motors 46 and 48. In the third position of valves 104 and 114, high pressure is supplied to conduits 112 and 120, respectively, and fluid is drained through conduits 110 and 118, respectively, to reverse the direction of rotation of motors 46 and/or 48 (as the case may be) during the process of ejecting a jamming object, as previously described. The positions of valves 104 and 114 are separately controlled by control lines 122 and 124 from microprocessor 70.

The apparatus of the present invention is easily maintained. Access door 126 in the top of housing 10 permits access to shredder chamber 16. Shafts 40 and 42 are easily disconnected from their respective motors 46 and 48 for removal and replacement of steel knives 50. Similarly, the steel cleaning assemblies 54 and 56 are mounted to the front and back walls of the housing by fasteners permitting easy replacement. Thus, while the steel knives and cleaning assemblies are rugged, the access door through the top of housing 10 permits replacement of worn knives and cleaning assemblies without disassembly of the shredder of the present invention from the compactor to which outlet 64 may be mounted, or from the auger to which the inlet 60 may be mounted. While the preferred embodiment of the present invention employs hydraulically-operated motors 36, 46 and 48 to perform the shredding and operate door 20, those skilled in the art will recognize that electric motors may be used in place of some or all of the hydraulic motors described.

The present invention is directed to a metal chips and shavings shredder that automatically ejects larger objects and cleans material from the space between the knives on the roller shafts. Using the present invention, larger objects are automatically ejected from the shredder without having to shut down the machine. The large objects are ejected through a different exit than the shredded material, thereby operating as a sorting device to sort such large objects from the shredded material. This eliminates the need to manually sort the shredded material to remove the larger objects and slowing down the subsequent compactor machine in the process. The apparatus is rugged in use and is easily maintained, and parts that are likely to be subject to wear are easily replaced.

Although the present invention has been described with reference to preferred embodiments, workers skilled in the art will recognize that changes may be made in form and detail without departing from the spirit and scope of the invention.

What is claimed is:

1. Apparatus for shredding metal shavings, chips and the like and for ejecting larger objects comprising:

a housing having an inlet for admitting metal chips and shavings to be shredded into a shredder chamber, an ejection outlet for discharging jamming objects from the shredder chamber, and a shredder outlet for discharging shredded shavings, chips and the like from the housing;

a shredder assembly in the housing between the shredder chamber and the shredder outlet for shredding metal shavings, chips and the like;

an ejection door movable between an open position permitting discharged jamming objects to be ejected through the ejection outlet and a closed position closing the ejection outlet, the ejection door being mounted in the housing and operable to sweep shavings, chips and the like from the shredder assembly when the ejection door moves from its closed to its open position; and a control operable to move the ejection door between its closed and open positions.

2. The apparatus of claim 1, wherein the housing has first and second opposing walls forming the shredder chamber, and the shredder assembly comprises:

a first roller shaft mounted between the first and second walls and rotatable about a first axis, a plurality of first knives axially mounted on the first roller shaft, a plurality of second knives positioned within the housing to mesh with the first knives to shred metal shavings, chips and the like upon rotation of the first roller shaft in a shredding direction, and a motor assembly for rotating the first roller shaft.

3. The apparatus of claim 2, including a first sensor operatively associated with the first roller shaft for sensing rotating motion of the first roller shaft, and a microprocessor coupled to the motor assembly for controlling rotation of the first roller shaft, the microprocessor being programmed to operate the motor assembly to rotate the first roller shaft in the shredding direction to shred metal shavings, chips and the like, the microprocessor being further programmed to respond to the first sensor sensing a change in motion of the first roller shaft due to a jamming object in the first knives to (i) operate the control to move the ejection door from its closed to its open position and (ii) operate the motor assembly to rotate the first roller shaft in a reverse direction opposite the shredding direction to dislodge the jamming object from the first knives and discharge the jamming object to the ejection outlet.

4. The apparatus of claim 3, wherein the microprocessor is further programmed to operate the control to move the ejection door from its open to its closed position after the jamming object has been ejected through the ejection outlet.

5. The apparatus of claim 4, including a second sensor for sensing the position of the ejection door, the microprocessor being further programmed to operate the motor assembly to operate the first roller shaft to its shredding direction in response to the second sensor sensing a closed position of the ejection door.

6. The apparatus of claim 2, wherein the control includes a door motor for moving the ejection door between its closed and its open position, the microprocessor being programmed to operate the door motor, a plurality of first and second followers on the ejection door, and first and second guides on each of the first and second walls, the first guides engaging the first followers and the second guides engaging the second followers, the first and second guides being so disposed and arranged as to guide the first and second followers to pivotly move the ejection door between its closed and open positions.

7. The apparatus of claim 6, wherein the door motor includes a plurality of hydraulic cylinders mounted to the housing, each cylinder having a shaft connected to one of the first followers.

8. The apparatus of claim 2, wherein the shredder assembly includes:

a second roller shaft mounted between the first and second walls and rotatable about a second axis, a first sensor operatively associated with at least one of the first and second roller shafts for sensing rotation of the respective roller shaft, a plurality of second knives being axially mounted to the second roller shaft, the second roller shaft being coupled to the motor assembly to rotate in a shredding direction to draw metal shavings, chips and the like into engagement with the first and second knives, a microprocessor coupled to the motor assembly for controlling rotation of the first and second roller shafts, the microprocessor being programmed to operate the motor assembly to rotate the first and second roller shafts in opposite directions to shred metal shavings, chips and the like, the microprocessor being further programmed to respond to the first sensor sensing a change in motion of the one roller shaft due to a jamming object in the knives of the one roller shaft to (i) operate the control to move the ejection door from its closed to its open position, (ii) operate the motor assembly to rotate the first roller shaft in a reverse direction opposite the shredding direction to dislodge the jamming object from the first knives and discharge the jamming object to the ejection outlet, and (iii) halt rotation of the second roller shaft during discharge of jamming objects to the ejection outlet.

9. The apparatus of claim 8, including a second sensor for sensing the position of the ejection door, the microprocessor being further programmed to operate the motor assembly to rotate the first and second roller shafts in their shredding direction in response to the second sensor sensing a closed position of the ejection door.

10. The apparatus of claim 8, wherein the shredder assembly further includes:

a plurality of first spacers on the first roller shaft, at least one first spacer between each adjacent first knife to space the first knives along the first roller shaft;

a first cleaning assembly mounted to the housing adjacent the first roller shaft, the first cleaning assembly having a plurality of first cleaning fingers extending into the space between the first knives to clean the space between the first knives;

a plurality of second spacers on the second roller shaft, at least one second spacer between each adjacent second knife to space the second knives along the second roller shaft;

a second cleaning assembly mounted to the housing adjacent the second roller shaft, the second cleaning assembly having a plurality of second cleaning fingers extending into the space between the second knives to clean the space between the second knives of material.

11. The apparatus of claim 8, wherein the housing is arranged so that the shredder assembly closes a lower portion of the shredder chamber and the inlet is positioned in a front wall of the housing, the first and second roller shafts being arranged so that the second knives are at least partially elevated in relation to the first knives and the inlet is adjacent and at least partially elevated in relation to the second knives so that shavings, chips and the like are fed by gravity toward the shredder assembly, and the ejection outlet is positioned in a rear wall of the housing opposite the front wall and adjacent the first knives at least partly below the elevation of the first knives so that discharged jamming objects are fed by gravity toward the ejection outlet.

12. The apparatus of claim 11, wherein the first and second knives include blade surfaces to engage metal shaving, chips and the like when the first and second roller shafts are rotated in the shredding direction and at least the first knives include a carrying surface opposite the blade surface to dislodge jamming objects toward the ejection outlet.

13. Apparatus for shredding metal shavings, chips and the like and for ejecting larger objects comprising:

a housing having an inlet in a first wall of the housing for admitting metal chips and shavings to be shredded into a shredder chamber, an ejection outlet in a second wall of the housing opposite the first wall for discharging jamming objects from the shredder chamber, and a shredder outlet below the inlet and ejection outlet for discharging shredded shavings, chips and the like from the housing;

a shredder assembly in the housing between the inlet and the shredder outlet for shredding metal shavings, chips and the like, the shredder assembly comprising:

a first roller shaft adjacent the ejector outlet carrying a plurality of knives, a second roller shaft adjacent the inlet carrying a plurality of knives, the knives on the second roller shaft meshing with the knives on the first roller shaft, the first and second roller shafts being arranged so that (i) the knives on the second shaft are at least partially elevated in relation to the knives on the first shaft, (ii) the inlet is adjacent and at least partially elevated in relation to the knives on the second shaft so that metal shavings, chips and the like are fed by gravity toward the shredder assembly, and (iii) the ejection outlet is at least partly below the elevation of the knives on the first shaft so that discharged jamming objects are fed by gravity and the knives on the first shaft toward the ejection outlet, and a motor assembly rotating the first and second roller shafts; and a microprocessor coupled to the motor assembly for controlling rotation of the first and second roller shafts, the microprocessor being programmed to operate the motor assembly to rotate the first and second roller shafts in opposite directions to shred metal shavings, chips and the like, and being responsive to a jamming object in the knives to operate the motor assembly to rotate the first roller shaft in a reverse direction opposite the shredding direction to dislodge the jamming object from the knives.

14. The apparatus of claim 13, including:

a first sensor operatively associated with the shredder assembly for sensing rotational motion of at least one of the roller shafts, and the microprocessor being further responsive to the first sensor sensing a change in motion of the shredder assembly due to a jamming object in the knives to operate the motor assembly to rotate the first roller shaft in the reverse direction and to halt rotation of the second roller shaft.

15. The apparatus of claim 14, wherein the first and second knives include blade surfaces to engage metal shavings, chips and the like when the first and second roller shafts are rotated in the shredding direction and at least the first knives include a carrying surface opposite the blade surface to dislodge jamming objects toward the ejection outlet.

16. The apparatus of claim 13, wherein the first and second knives include blade surfaces to engage metal shavings, chips and the like when the first and second roller shafts are rotated in the shredding direction and at least the first knives include a carrying surface opposite the blade surface to dislodge jamming objects toward the ejection outlet.

17. The apparatus of claim 13, further including an ejection door movable between an open position permitting discharged jamming objects to be ejected through the ejection outlet and a closed position closing the ejection outlet, the ejection door being mounted in the housing and operable to sweep shavings, chips and the like from the shredder assembly when the ejection door moves from its closed to its open position, the microprocessor being responsive to a jamming object in the knives to move the ejection door to its open position.

18. The apparatus of claim 17, further including a second sensor for sensing the position of the ejection door, the microprocessor being further programmed to operate the motor assembly to rotate the first and second roller shafts in their shredding direction in response to the second sensor sensing a closed position of the ejection door.

* * * * *